US009531126B2

(12) United States Patent
Krietzman et al.

(10) Patent No.: US 9,531,126 B2
(45) Date of Patent: Dec. 27, 2016

(54) ELECTRICAL RECEPTACLE WITH LOCKING FEATURE

(71) Applicant: CHATSWORTH PRODUCTS, INC., Westlake Village, CA (US)

(72) Inventors: William Drew Krietzman, Castle Rock, CO (US); Richard Evans Lewis, II, Austin, TX (US)

(73) Assignee: Chatsworth Products, Inc., Westlake Village, CA (US)

( * ) Notice: Subject to any disclaimer, the term of this patent is extended or adjusted under 35 U.S.C. 154(b) by 0 days.

(21) Appl. No.: 14/732,234

(22) Filed: Jun. 5, 2015

(65) Prior Publication Data

US 2015/0357758 A1 Dec. 10, 2015

Related U.S. Application Data

(60) Provisional application No. 62/008,124, filed on Jun. 5, 2014.

(51) Int. Cl.
*H01R 13/639* (2006.01)

(52) U.S. Cl.
CPC ..... *H01R 13/639* (2013.01); *H01R 13/6392* (2013.01)

(58) Field of Classification Search
CPC ... H01R 13/6272; H01R 13/639; H01R 13/52; H01R 13/5219; H01R 13/6275; H01R 13/629
See application file for complete search history.

(56) References Cited

U.S. PATENT DOCUMENTS 1,835,251 A 12/1931 Wetstein
2,271,463 A 1/1942 Reeves
(Continued)

FOREIGN PATENT DOCUMENTS

BR PI0413990 A 7/2006
CA 2535374 A1 3/2005
(Continued)

OTHER PUBLICATIONS

Specification from WIREMOLD.com—Plug-In Outlet Center® Units—ED795R4, updated Mar. 2003 (8 pages).
(Continued)

*Primary Examiner* — Truc Nguyen
(74) *Attorney, Agent, or Firm* — Tillman Wright, PLLC; James D. Wright; David R. Higgins

(57) ABSTRACT

A ganged electrical receptacle unit with locking feature includes a plurality of receptacles and a lock housing. The electrical receptacles are ganged together. The lock housing extends from a front of the receptacles and includes a pair of opposed side supports, a pair of torsion bars, each extending between the opposed side supports, a lock tab extending from each torsion bar toward the receptacle, and a release tab extending from each torsion bar away from the receptacle. A plug may be inserted into the lock housing causing temporary deflection of the lock tabs until the plug is seated in, and electrically connected with, the receptacle, at which point the lock tabs return to their undeflected positions and retain the plug in the receptacle. The release tabs may be depressed to release the lock tabs from the plug, thereby permitting the withdrawal of the plug from the lock housing.

24 Claims, 14 Drawing Sheets

(56) References Cited

U.S. PATENT DOCUMENTS 3,633,075 A 1/1972 Hawkins
4,531,800 A 7/1985 Avener
4,675,900 A 6/1987 Temkin
4,782,245 A 11/1988 Henry
5,104,335 A 4/1992 Conley et al.
5,370,553 A 12/1994 Zimmerman
5,391,084 A 2/1995 Kreitzman
5,568,362 A 10/1996 Hansson
D375,292 S 11/1996 D'Amato
5,595,494 A 1/1997 Wiebe
5,626,316 A 5/1997 Smigel et al.
5,707,248 A * 1/1998 Matsumura ..... H01R 13/641 439/352
5,788,087 A 8/1998 Orlando
5,921,795 A 7/1999 Weener et al.
5,921,806 A 7/1999 Shuey
5,954,525 A 9/1999 Siegal et al.
6,127,631 A 10/2000 Green et al.
6,144,549 A 11/2000 Moss et al.
6,168,249 B1 1/2001 Chien
6,220,880 B1 4/2001 Lee et al.
6,231,379 B1 5/2001 Shen
6,250,816 B1 6/2001 Johnston et al.
6,250,956 B1 6/2001 Pulizzi
6,280,243 B1 8/2001 Liu et al.
6,315,580 B1 11/2001 Hurtubise et al.
D462,056 S 8/2002 Chung
6,461,052 B1 10/2002 Hines et al.
6,541,705 B1 4/2003 McGrath
6,584,267 B1 6/2003 Caveney et al.
6,609,034 B1 8/2003 Behrens et al.
6,647,197 B1 11/2003 Marrs et al.
6,663,435 B2 12/2003 Lincoln et al.
6,671,756 B1 12/2003 Thomas et al.
6,672,896 B1 1/2004 Li
6,738,555 B1 5/2004 Cooke et al.
6,760,531 B1 7/2004 Solheid et al.
6,761,583 B2 7/2004 Ortowski et al.
6,781,491 B2 8/2004 Whipple et al.
6,782,617 B2 8/2004 Pulizzi
6,818,834 B1 11/2004 Lin
6,835,094 B2 * 12/2004 Matsushita ..... H01R 13/5202 439/271
6,843,674 B1 1/2005 Young
6,845,207 B2 1/2005 Schray
6,866,541 B2 3/2005 Barker et al.
6,937,461 B1 8/2005 Donahue, IV
6,981,893 B2 1/2006 Barker et al.
6,992,247 B2 1/2006 Rasmussen et al.
7,043,543 B2 5/2006 Ewing et al.
7,081,004 B1 7/2006 Puzio
7,092,258 B2 8/2006 Hardt et al.
7,097,047 B2 8/2006 Lee et al.
7,141,891 B2 11/2006 McNally et al.
7,171,461 B2 1/2007 Ewing et al.
7,200,316 B2 4/2007 Giraud et al.
7,232,337 B1 * 6/2007 Pepe ..... H01R 13/743 439/549
D549,650 S 8/2007 Russell et al.
7,268,998 B2 9/2007 Ewing et al.
7,277,614 B2 10/2007 Cody et al.
7,285,027 B2 10/2007 McGrath et al.
7,289,334 B2 10/2007 Behrens et al.
7,312,980 B2 12/2007 Ewing et al.
D559,184 S 1/2008 Russell et al.
D562,766 S 2/2008 Yang
7,330,629 B2 2/2008 Cooke et al.
D564,964 S 3/2008 Caine et al.
7,345,241 B2 3/2008 Caveney et al.
7,352,947 B2 4/2008 Phung et al.
7,362,941 B2 4/2008 Rinderer et al.
7,365,964 B2 4/2008 Donahue, IV
7,368,830 B2 5/2008 Cleveland et al.
7,406,242 B1 7/2008 Braga
D575,237 S 8/2008 Shiga et al.
7,414,329 B2 8/2008 Cleveland et al.
D576,552 S 9/2008 Caine et al.
7,472,970 B2 1/2009 Bergesch et al.
7,480,154 B2 1/2009 Lawrence et al.
7,510,421 B2 3/2009 Fransen et al.
7,551,456 B2 6/2009 Behrens et al.
7,637,771 B2 12/2009 Laursen
7,661,982 B2 2/2010 Tachi et al.
7,686,647 B1 * 3/2010 Hong ..... H01R 9/0518 439/595
7,702,771 B2 4/2010 Ewing et al.
7,718,889 B2 5/2010 Rasmussen et al.
7,719,835 B1 5/2010 Schluter
7,751,206 B2 7/2010 Kosacek et al.
7,777,365 B2 8/2010 Cleveland et al.
7,778,513 B2 8/2010 Rinderer et al.
7,789,679 B2 9/2010 Wu et al.
7,816,602 B2 10/2010 Landry et al.
D631,731 S 2/2011 Chen
7,891,993 B2 2/2011 Huber et al.
7,957,139 B2 6/2011 Davis et al.
7,974,105 B2 7/2011 Dean, Jr. et al.
8,033,867 B1 10/2011 Kessler et al.
8,152,554 B2 4/2012 Chapel et al.
D660,235 S 5/2012 Liang-Hsu et al.
8,238,080 B2 8/2012 McGinn
D677,629 S 3/2013 Corona
D678,200 S 3/2013 Corona
D678,202 S 3/2013 Corona
8,411,465 B2 4/2013 Dean, Jr. et al.
8,437,147 B2 5/2013 Dean, Jr. et al.
D687,778 S 8/2013 Utz
8,882,536 B2 11/2014 Utz
9,054,449 B2 6/2015 Utz et al.
2001/0027054 A1 * 10/2001 Fukuda ..... H01R 13/641 439/489
2002/0064997 A1 * 5/2002 Noguchi ..... H01R 13/641 439/607.01
2002/0119693 A1 * 8/2002 Chen ..... H01R 13/6272 439/358
2002/0173197 A1 * 11/2002 Endo ..... H01R 13/641 439/489
2002/0176681 A1 11/2002 Puetz et al.
2003/0118311 A1 6/2003 Thibault et al.
2003/0190036 A1 10/2003 Mandoza
2004/0050808 A1 3/2004 Krampotich et al.
2004/0055232 A1 3/2004 Jette
2004/0077212 A1 4/2004 Pulizzi
2004/0146266 A1 7/2004 Solheid et al.
2004/0231875 A1 11/2004 Rasmussen et al.
2005/0050272 A1 3/2005 Behrens et al.
2005/0057912 A1 3/2005 Hardt et al.
2005/0111810 A1 5/2005 Giraud et al.
2005/0259383 A1 11/2005 Ewing et al.
2006/0103270 A1 5/2006 Bergesch et al.
2006/0118321 A1 6/2006 Herring et al.
2006/0118685 A1 6/2006 Schluter et al.
2006/0154503 A1 7/2006 Kidman
2006/0162948 A1 7/2006 Rinderer et al.
2006/0171075 A1 8/2006 Caveney et al.
2006/0263029 A1 11/2006 Mudd et al.
2007/0097659 A1 5/2007 Behrens et al.
2007/0149020 A1 * 6/2007 Matsumoto ..... H01R 13/622 439/164
2007/0207666 A1 9/2007 Caveney et al.
2008/0030947 A1 2/2008 Behrens et al.
2008/0062654 A1 3/2008 Mattlin et al.
2008/0062655 A1 3/2008 Laursen et al.
2008/0130262 A1 6/2008 Rinderer et al.
2008/0180917 A1 7/2008 Lawrence
2008/0194137 A1 8/2008 Kuo
2008/0261437 A1 * 10/2008 Kobayashi ..... H01R 13/6272 439/352
2008/0318473 A1 * 12/2008 Morikawa ..... H01R 13/5208 439/588
2009/0038845 A1 2/2009 Fransen et al.
2009/0206217 A1 8/2009 Wilson et al.
2009/0273915 A1 11/2009 Dean, Jr. et al.

(56) References Cited

U.S. PATENT DOCUMENTS

| | | | | |
|---|---|---|---|---|
| 2010/0051308 | A1 | 3/2010 | Hansen et al. | |
| 2010/0193754 | A1 | 8/2010 | Garza et al. | |
| 2010/0200707 | A1 | 8/2010 | Garza et al. | |
| 2010/0296229 | A1 | 11/2010 | Meux et al. | |
| 2011/0083873 | A1 | 4/2011 | Hartman et al. | |
| 2011/0177710 | A1* | 7/2011 | Tobey | H01R 13/514 439/345 |
| 2011/0201228 | A1* | 8/2011 | Schumacher | H01R 13/4368 439/374 |
| 2011/0211328 | A1 | 9/2011 | Dean, Jr. et al. | |
| 2011/0211329 | A1 | 9/2011 | Dean, Jr. et al. | |
| 2011/0256750 | A1* | 10/2011 | Chen | H01R 13/506 439/345 |
| 2013/0196532 | A1 | 8/2013 | Utz et al. | |
| 2013/0196535 | A1 | 8/2013 | Utz | |
| 2013/0215581 | A1 | 8/2013 | Utz | |
| 2015/0222047 | A1 | 8/2015 | Utz et al. | |

FOREIGN PATENT DOCUMENTS

| | | | |
|---|---|---|---|
| CN | 1842948 | A | 10/2006 |
| WO | 9918580 | A2 | 4/1999 |
| WO | 2005025374 | A2 | 3/2005 |
| WO | 2005025374 | A3 | 12/2005 |
| WO | 2006055506 | A2 | 5/2006 |
| WO | 2009089008 | A2 | 7/2009 |
| WO | 2015188116 | A1 | 12/2015 |

OTHER PUBLICATIONS

C14 Plug Lock, Tripp-Lite, http://www.tripplite.com/c14-plug-lock-insert-for-c13-outlets-blue~PLC13BL/, dated as of May 30, 2013, accessed Aug. 25, 2015 (4 pages).

"International Search Report" and "Written Opinion" of the International Search Authority (ISA/US) in Chatsworth Products, Inc., International Patent Application Serial No. PCT/US2015/034511, dated Sep. 15, 2015 (13 pages).

* cited by examiner prior art

ELECTRICAL RECEPTACLE WITH LOCKING FEATURE

CROSS-REFERENCE TO RELATED APPLICATION

The present application is a U.S. non-provisional patent application of, and claims priority under 35 U.S.C. §119(e) to, U.S. provisional patent application Ser. No. 62/008,124, filed Jun. 5, 2014 and entitled, "ELECTRICAL RECEPTACLE WITH LOCKING FEATURE," which '124 application is incorporated by reference herein in its entirety.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to power cords and their connectors, and, in particular, to plug retention devices for electrical receptacles.

Background

Power cords are ubiquitous in the developed world, providing power from a conventional distribution system to electrically-powered devices of a very wide variety of types. Each power cord usually includes a cable with a plug or other electrical fitting at each end. For residential devices, most power cords utilize a plug having a standard size and arrangement of electrical connectors, with the particular standard being specific to a particular country or set of countries. Power cords for devices having electrical requirements that are different from that standard frequently utilize different sizes and/or arrangements to ensure that the wrong plug is not connected thereto.

In the computer industry, specialized plug/receptacle pairs are likewise used for various electrical needs. The plug/receptacle pairs are typically selected from conventional receptacle designs such as those set forward by IEC 60320. According to the standard, the specifications of corresponding female and male pairs of electrical connectors (such as C13 and C14 types) are defined such that the physical attributes of those connectors are standardized. By way of example, FIG. 1 is a front isometric view of a conventional female electrical receptacle. The illustrated receptacle is in the form of a panel-mount C13-type receptacle, but it will be appreciated that various other receptacle types with different electrical connection configurations also exist. The receptacle includes a female fitting surrounded by a socket. Female electrical contacts are contained within the female fitting. A plate may be provided on the front of, and typically integral with, the socket. The receptacle may be mounted in various fixtures using screws, solder joints, or in other known ways; the receptacle (and especially the socket) may include additional features to facilitate such mounting. The female electrical receptacle is adapted to receive a corresponding male electrical receptacle (not shown in FIG. 1). Such a male receptacle would typically include a male fitting from which male electrical contacts extend as well as a socket surrounding the male electrical contacts.

A common problem within the computer industry and without is the accidental dislocation of a particular plug (connector) from a receptacle. Because each plug commonly has a cord extending therefrom, it is easy to generate enough force, accidentally, to loosen the plug in the receptacle or even to pull it out entirely. Contributing to the problem is the fact that many connectors are designed to be removed easily by hand, which means that the force necessary to loosen or remove the plug is often not particularly great. The problem can be particularly vexing around power distribution units (PDUs).

As a result, many devices and techniques have been used to hold plugs in place. These include plugs that include threaded fittings (e.g., screws) that may be coupled to corresponding fittings on the receptacle, a retention element installed on the cord that can be attached to a stud or other element of the receptacle or PDU, bars or brackets fastened to the receptacle or PDU once the plug or plugs are in place, and the like. All of these have problems, from the need for special connector designs to their difficulty of use, particularly with regard to their ease of installation and removal. Thus, a need exists for a solution that does not require changes to the plug but which allows for easy installation and removal of the plug in and from a receptacle, while reliably holding the plug in place while installed.

SUMMARY OF THE PRESENT INVENTION

Broadly defined, the present invention according to one aspect is an electrical receptacle with locking feature as shown and described.

Broadly defined, the present invention according to another aspect is an electrical receptacle with locking feature, including: a receptacle adapted to be electrically connected to a source of electricity and having a front face; and a lock housing extending from the front face of the receptacle.

Broadly defined, the present invention according to another aspect is an electrical receptacle with locking feature, including: a receptacle adapted to be electrically connected to a source of electricity and having a front face; and a lock housing extending from the front face of the receptacle, wherein the lock housing includes a pair of opposed side supports, a pair of torsion bars, each extending between and supported by the opposed side supports, a respective lock tab extending from each torsion bar toward the receptacle, and a respective release tab extending from each torsion bar away from the receptacle; wherein a plug may be inserted into the lock housing such that the plug causes the temporary deflection of the lock tabs until the plug is seated in, and electrically connected with, the receptacle, at which point the lock tabs return to their undeflected positions and retain the plug in the receptacle in its electrically connected state; and wherein the release tabs may be depressed to release the lock tabs from the plug, thereby permitting the withdrawal of the plug from the lock housing.

Broadly defined, the present invention according to another aspect is a ganged electrical receptacle unit with locking feature as shown and described.

Broadly defined, the present invention according to another aspect is a ganged electrical receptacle unit with locking feature, including: a plurality of receptacles ganged together and having a front face, the ganged receptacles being adapted to be electrically connected to a source of electricity; and a lock housing extending from the front face of at least one of the ganged receptacles.

In a feature of this aspect, a respective lock housing extends from the front face of each of the ganged receptacles. In a further feature, each lock housing includes a pair of opposed side supports, a pair of torsion bars, each extending between and supported by the opposed side supports, a respective lock tab extending from each torsion bar toward the respective ganged receptacle, and a respective release tab extending from each torsion bar away from the respective ganged receptacle; a plug may be inserted into each respective lock housing such that the plug causes the temporary deflection of the lock tabs until the plug is seated in, and electrically connected with, the respective ganged receptacle, at which point the lock tabs return to their undeflected positions and retain the plug in the respective ganged receptacle in its electrically connected state; and the release tabs may be depressed to release the lock tabs from the plug, thereby permitting the withdrawal of the plug from the respective lock housing.

In a further feature, each pair of adjacent receptacles shares a side support.

In another further feature, the lock housings are ganged together. In still further features, the lock housings are integral with one another, or the lock housings are produced separately but are attached to each other.

In another further feature, the lock housings are integral with the ganged receptacles.

In another further feature, the lock housings are produced separately from the ganged receptacles but are attached to the ganged receptacles.

In another further feature, each lock housing includes a front plate from which the side supports extend.

In another further feature, the plug and receptacle are of a C13/C14-type.

Broadly defined, the present invention according to another aspect is a ganged electrical receptacle unit with locking feature, including: a plurality of receptacles ganged together and having a front face, the ganged receptacles being adapted to be electrically connected to a source of electricity; and a lock housing extending from the front face of at least one of the ganged receptacles, wherein the lock housing includes a pair of opposed side supports, a pair of torsion bars, each extending between and supported by the opposed side supports, a respective lock tab extending from each torsion bar toward the at least one ganged receptacle, and a respective release tab extending from each torsion bar away from the at least one ganged receptacle; a plug may be inserted into the lock housing such that the plug causes the temporary deflection of the lock tabs until the plug is seated in, and electrically connected with, the at least one ganged receptacle, at which point the lock tabs return to their undeflected positions and retain the plug in the at least one ganged receptacle in its electrically connected state; and the release tabs may be depressed to release the lock tabs from the plug, thereby permitting the withdrawal of the plug from the lock housing.

Broadly defined, the present invention according to another aspect is an electrical receptacle unit with locking feature, including: a receptacle adapted to be electrically connected to a source of electricity and having a front; and a lock housing extending from the front of the receptacle and adapted to surround a plug and temporarily lock the plug in place in coupling disposition with regard to the receptacle.

In a feature of this aspect, the receptacle includes an electrical fitting, having electrical contacts contained therein and/or extending therefrom; the receptacle includes a socket surrounding the electrical fitting; and the lock housing extends from a plate disposed on the front of the socket. In a further feature, the electrical fitting is a first electrical fitting; the lock housing includes a pair of opposed side supports, a pair of torsion bars, each torsion bar extending between and supported by the opposed side supports, and a respective lock tab extending from each torsion bar toward the electrical fitting; and a plug, including a second electrical fitting that mates to the first electrical fitting, may be inserted into the lock housing such that the plug causes the temporary deflection of the lock tabs until the plug is coupled to, and electrically connected with, the receptacle, at which point the lock tabs return to their undeflected positions and retain the plug coupled to the receptacle in its electrically connected state. In still further features, the lock housing includes a respective release tab extending from each torsion bar away from the electrical fitting; and the release tabs may be depressed to release the lock tabs from the plug, thereby permitting the withdrawal of the plug from the lock housing; the opposed side supports are upper and lower side supports; the opposed side supports are left and right side supports; the receptacle is a panel-mount receptacle; the socket of the receptacle includes walls, at least one of which walls includes a locking tab that retains the receptacle in a fixture; the electrical fitting is a female electrical fitting having female electrical contacts contained therein; and/or the plug and receptacle are of a C13/C14-type.

In another feature of this aspect, the receptacle includes an electrical fitting, having electrical contacts contained therein and/or extending therefrom; and the lock housing extends from a plate disposed on the front of the electrical fitting.

Broadly defined, the present invention according to another aspect is a ganged electrical receptacle unit with locking feature, including: a plurality of receptacles ganged together and each having a front, the ganged receptacles being adapted to be electrically connected to a source of electricity; and a lock housing extending from the front of at least one of the ganged receptacles and adapted to surround a plug and temporarily lock the plug in place in coupling disposition with regard to the at least one ganged receptacle.

In a feature of this aspect, a respective lock housing extends from the front of each of the ganged receptacles. In a further feature, for each respective receptacle and lock housing, the receptacle includes an electrical fitting, having electrical contacts contained therein and/or extending therefrom, the receptacle includes a respective socket surrounding the electrical fitting, and the lock housing extends from a plate disposed on the front of the socket. In a still further feature, for each respective receptacle and lock housing the electrical fitting is a respective first electrical fitting; the lock housing includes a pair of opposed side supports, a pair of torsion bars, each torsion bar extending between and supported by the opposed side supports, a respective lock tab extending from each torsion bar toward the electrical fitting, and the lock housing includes a respective release tab extending from each torsion bar away from the electrical fitting; a plug, including a second electrical fitting that mates to the first electrical fitting, may be inserted into the lock housing such that the plug causes the temporary deflection of the lock tabs until the plug is coupled to, and electrically connected with, the receptacle, at which point the lock tabs return to their undeflected positions and retain the plug coupled to the receptacle in its electrically connected state; and the release tabs may be depressed to release the lock tabs from the plug, thereby permitting the withdrawal of the plug from the lock housing. In still further features, each pair of adjacent receptacles shares a side support; the lock housings are ganged together; the lock housings are integral with one another; the lock housings are produced separately but are attached to each other; the lock housings are integral with the ganged receptacles; the lock housings are produced separately from the ganged receptacles but are attached to the ganged receptacles; and each lock housing includes a front plate from which the side supports extend.

Broadly defined, the present invention according to another aspect is a ganged electrical receptacle unit with locking feature, including: a plurality of receptacles ganged together, the ganged receptacles being adapted to be electrically connected to a source of electricity, wherein each receptacle includes a first electrical fitting and a respective socket, having a front, that surrounds the first electrical fitting; and a lock housing extending from the front of the socket of at least one of the ganged receptacles, wherein the lock housing includes a pair of opposed side supports, a pair of torsion bars, each torsion bar extending between and supported by the opposed side supports, a respective lock tab extending from each torsion bar toward the at least one ganged receptacle, and a respective release tab extending from each torsion bar away from the at least one ganged receptacle; wherein a plug, including a second electrical fitting that mates to the first electrical fitting, may be inserted into the lock housing such that the plug causes the temporary deflection of the lock tabs until the plug is seated in, and electrically connected with, the at least one ganged receptacle, at which point the lock tabs return to their undeflected positions and retain the plug coupled to the at least one ganged receptacle in its electrically connected state; and wherein the release tabs may be depressed to release the lock tabs from the plug, thereby permitting the withdrawal of the plug from the lock housing Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
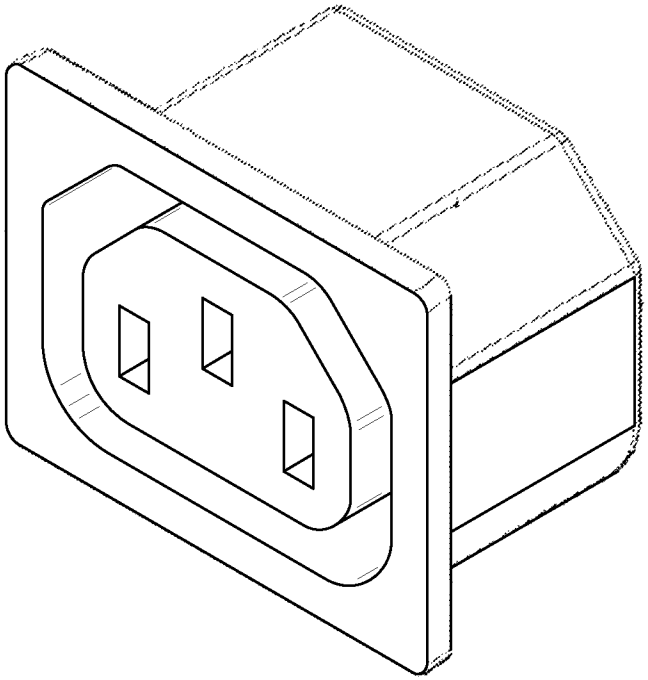
FIG. 1 is a front isometric view of a conventional female electrical receptacle.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Figure 2:
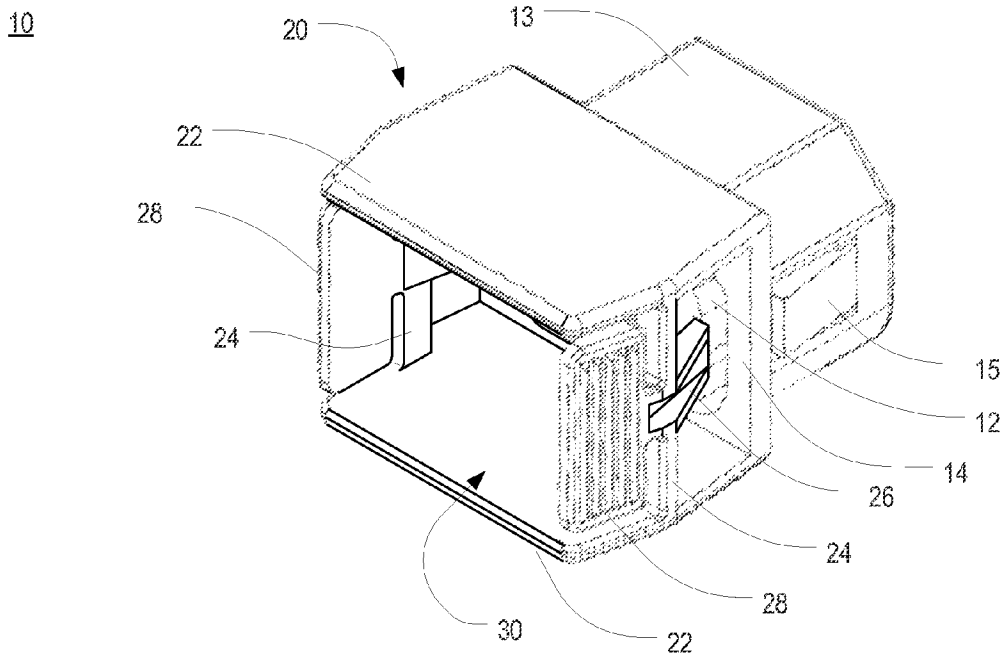
FIG. 2 is a front isometric view of an electrical receptacle unit with locking feature in accordance with a preferred embodiment of the present invention.

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses. FIG. 2 is a front isometric view of an electrical receptacle unit 10 with locking feature in accordance with a preferred embodiment of the present invention. As shown therein, the electrical receptacle unit 10 includes a female electrical fitting 12, a surrounding socket 13, and a lock housing 20 extending from the front of the surrounding socket 13. The illustrated female fitting 12 is in the form of a panel-mount C13-type receptacle, but it will be appreciated that various other receptacle types with different electrical connection configurations also exist. Female electrical contacts similar to those of the fitting in FIG. 1 are contained within the female fitting 12. A plate 14 is provided on the front of the socket 13. In at least some embodiments, the plate 14 is integral with the socket 13, but in other embodiments the plate 14 may be attached during or after manufacturing. Further, in some alternative embodiments, the plate is omitted entirely. In other embodiments, the plate is integral with, or attached to, the electrical fitting.

Figure 3:
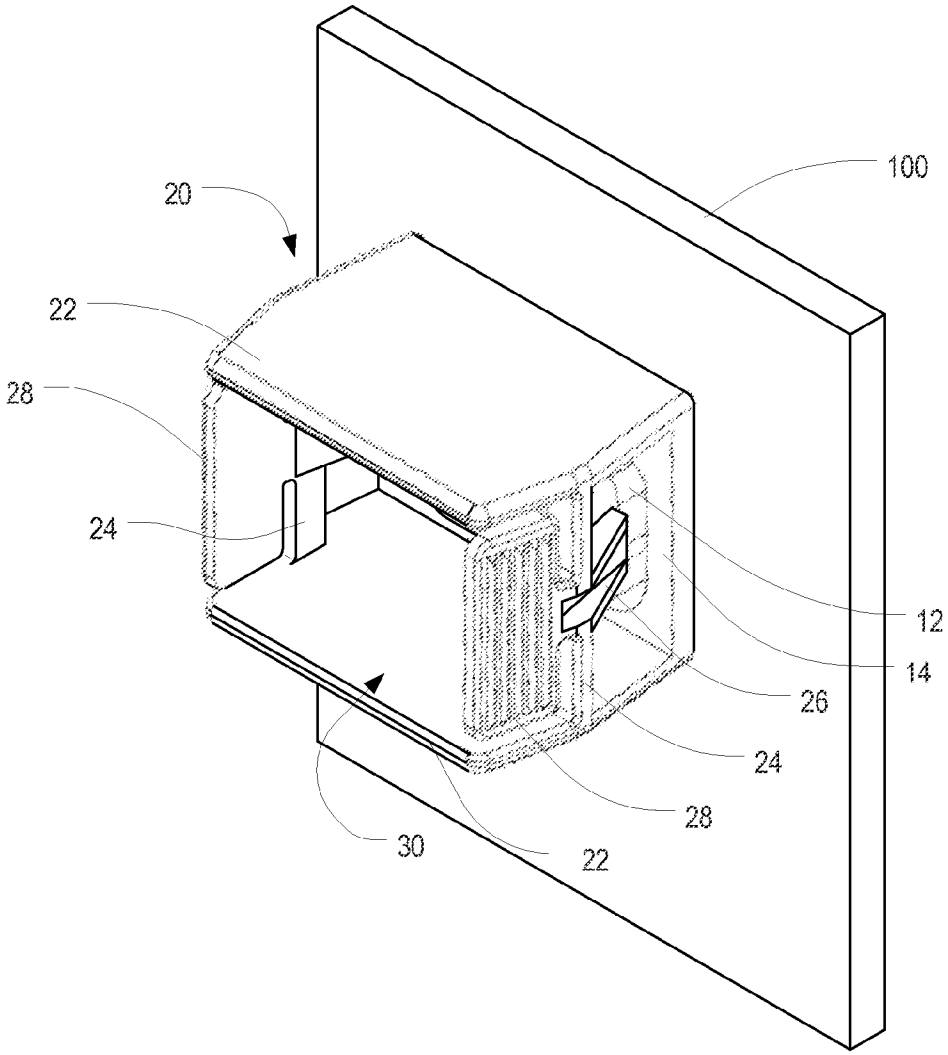
FIG. 3 is a front isometric view of the electrical receptacle unit of FIG. 2 shown mounted in a fixture, wherein the fixture is illustrated schematically.

FIG. 3 is a front isometric view of the electrical receptacle unit 10 of FIG. 2 shown mounted in a fixture 100, wherein the fixture 100 is illustrated schematically. The receptacle unit 10 may be mounted in various fixtures using screws, solder joints, or in other known ways; the receptacle (and especially the socket) may include additional features to facilitate such mounting. In accordance with one or more preferred approaches to mounting the receptacle unit 10, the walls of the socket 13 may include locking tabs 15 (as can be seen in FIG. 4) that are naturally depressed as the socket 13 is maneuvered into position in the fixture 100, but are biased to spring outward when the socket 13 is fully inserted into such fixture 100, thereby holding the receptacle unit 10 in place in the fixture 100.

In at least some embodiments, the lock housing 20 is integral with the socket 13 of the receptacle unit and is co-manufactured with the socket 13, while in others the lock housing 20 is manufactured separately from the socket 13 and is fastened thereto. The lock housing 20 includes opposed side supports 22 connected by a pair of torsion bars 24. In the illustrated embodiment, the side supports 22 extend forwardly from the plate 14, but it will be appreciated that side supports or similar structures could alternatively or additionally extend from other portions of the socket 13 or other structure. It will also be appreciated that although the side supports 22 are located on the upper and lower sides of the lock housing 20, side supports could alternatively be located on the left and right sides of a lock housing. Each torsion bar 24 supports a lock tab 26 and a release tab 28 extending in generally opposite directions therefrom. The side supports 22 and release tabs 28 collectively frame a lock housing opening 30.

The female electrical fitting 12 is adapted to receive a corresponding male electrical fitting. In this regard, FIG. 4 is a front isometric view of the electrical receptacle unit 10 of FIG. 2, shown with a power cord connected thereto, and FIG. 5 is a front isometric view of the electrical receptacle unit 10 of FIG. 4, shown with the power cord removed therefrom. As shown in cross-section in FIGS. 6A-6F, the power cord includes a plug 40 attached to the end of an electrical cable 44. The plug 40 includes a male fitting 42, from which male electrical contacts 41, extend as well as a socket 43 surrounding the male electrical contacts 41. As shown in FIGS. 4 and 5, the plug 40 may be guided through the lock housing opening 30 and then inserted into the receptacle unit 10 such that a conventional electrical connection is established and maintained. In at least some embodiments, the plug 40 is of conventional construction, as is the electrical cable 44 to which it is attached. When fully seated in the lock housing opening 30 and socket 13, as shown in FIG. 4, the plug 40 is retained by the lock housing 20 such that it will not become "unplugged" or otherwise disconnected accidentally.

Figure 4:
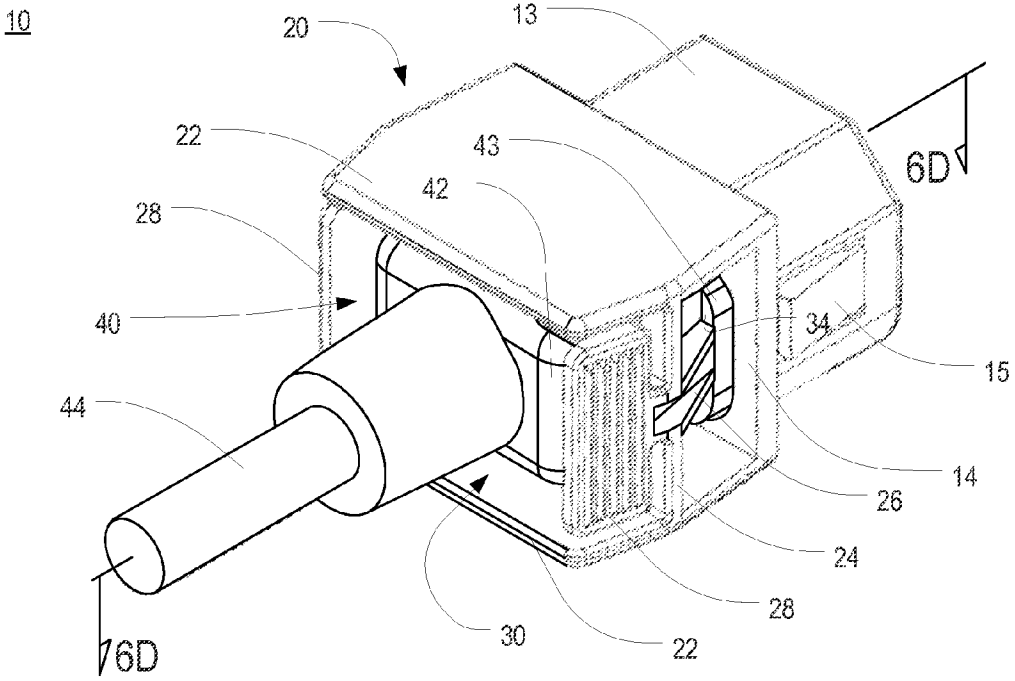
FIG. 4 is a front isometric view of the electrical receptacle unit of FIG. 2, shown with a power cord connected thereto.
Figure 5:
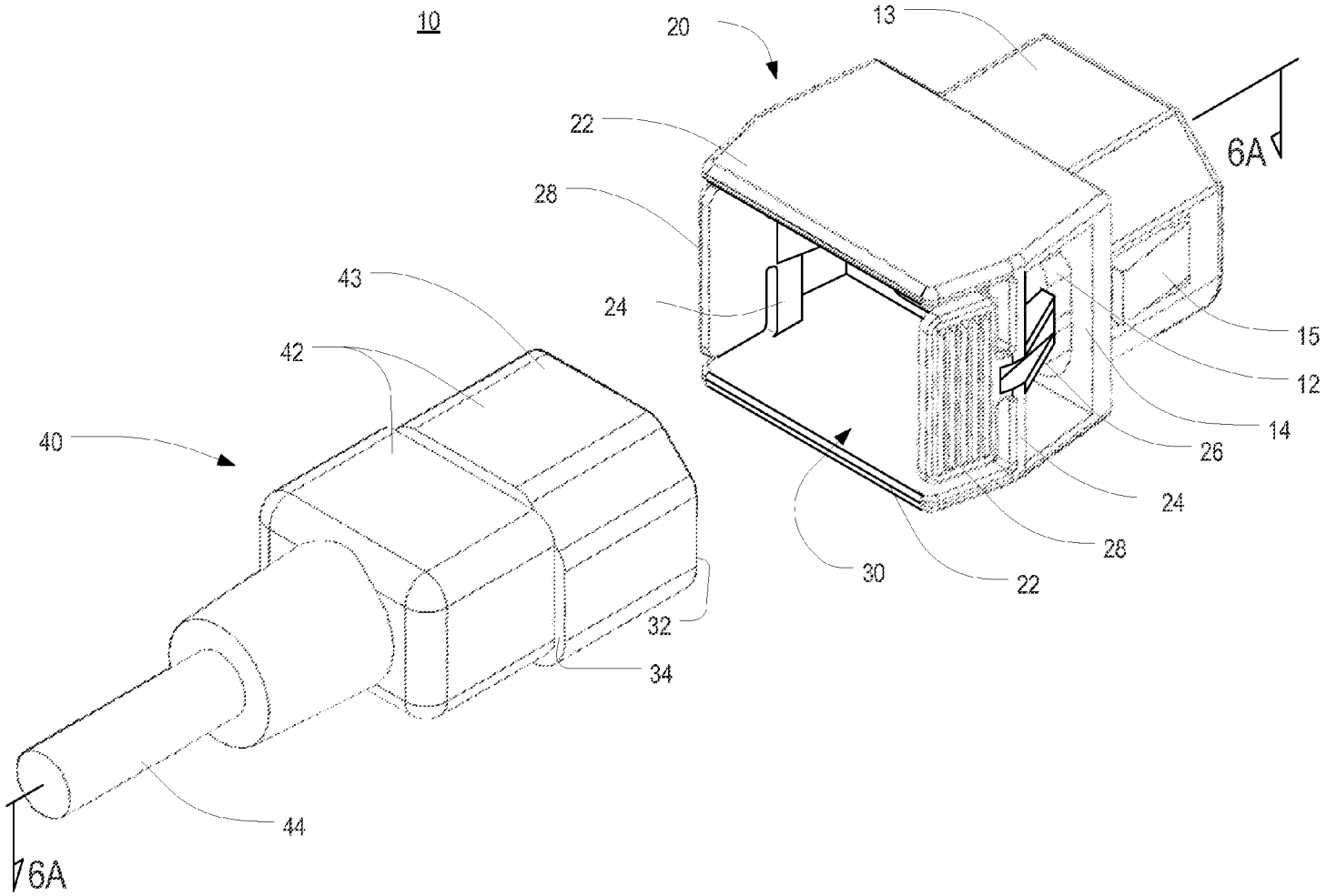
FIG. 5 is a front isometric view of the electrical receptacle unit of FIG. 4, shown with the power cord removed therefrom.
Figure 6A:
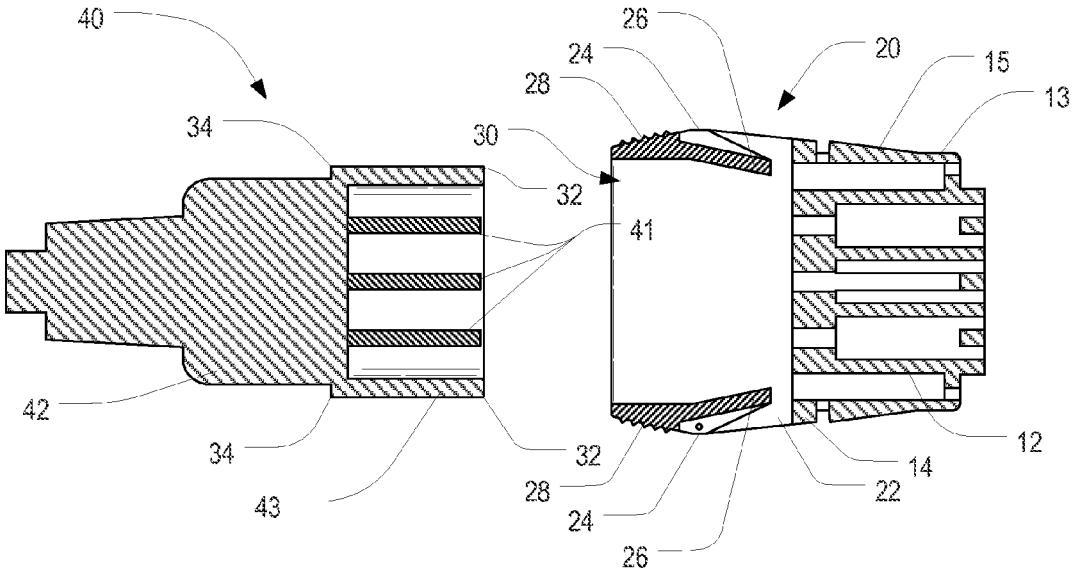
FIG. 6A is a top cross-sectional view of the electrical receptacle unit and plug of FIG. 5, taken along line 6A-6A.
Figure 6B:
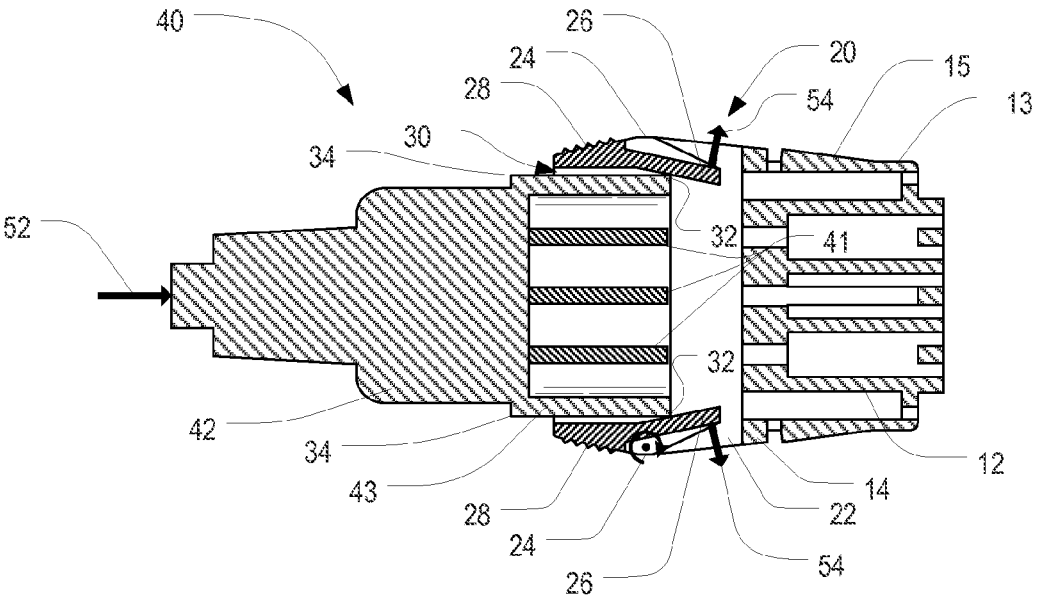
FIG. 6B is a top cross-sectional view of the electrical receptacle unit and plug of FIG. 6A, shown with the plug partially inserted into the receptacle.
Figure 6C:
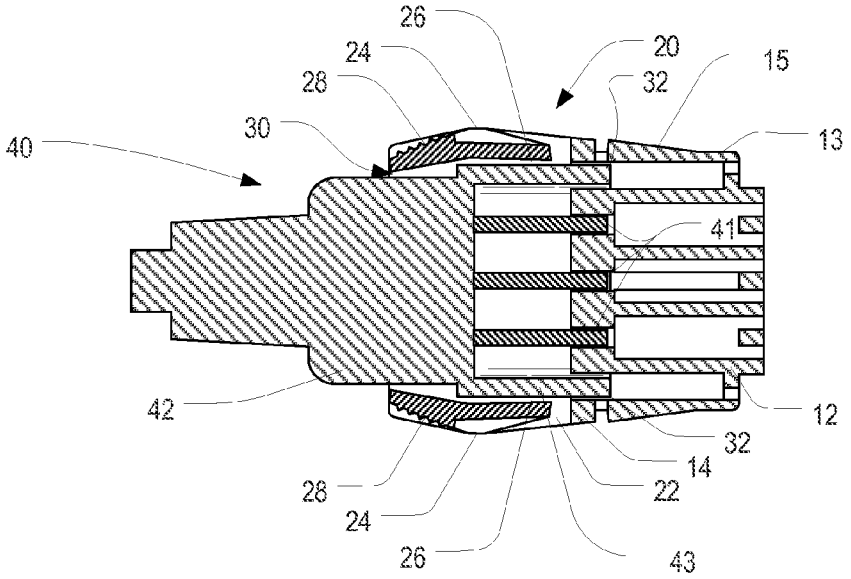
FIG. 6C is a top cross-sectional view of the electrical receptacle unit and plug of FIG. 6A, shown with the plug more fully inserted into the receptacle.

FIGS. 6A-6F are a series of top cross-sectional views of the electrical receptacle unit 10 and plug 40 of FIGS. 4 and 5. In FIGS. 6A-6F, a circular arrow is sometimes used to illustrated rotational movement of the lock tabs 26 around the axis defined by the torsion bars 24, which are designed to be flexible and resilient enough to facilitate such temporary rotation. As shown in FIG. 6A, which is a top cross-sectional view of the electrical receptacle unit 10 and plug 40 of FIG. 5, taken along line 6A-6A, the plug 40 is aligned with the lock housing opening 30 and socket 13. As the plug 40 is guided into the lock housing opening 30, as shown in FIG. 6B, leading edges 32 of the sides of the socket 43 make contact with the lock tabs 26 of the lock housing 20. When sufficient force 52 is applied to the plug 40, the leading edges 32 cause the lock tabs 26 to begin deflecting outward as represented by the arrows 54. In particular, the lock tabs 26 begin rotating around the axis defined by the torsion bars 24, which as described previously are designed to be flexible and resilient enough to facilitate such temporary rotation. Because the release tabs 28 are likewise supported by the torsion bars 24, the release tabs 28 rotate slightly as well. As shown in FIG. 6C, when the lock tabs 26 have rotated sufficiently to accommodate the width of the plug 40, the plug 40 may be guided into mating relationship with the female electrical fitting 12 itself.

Figure 6D:
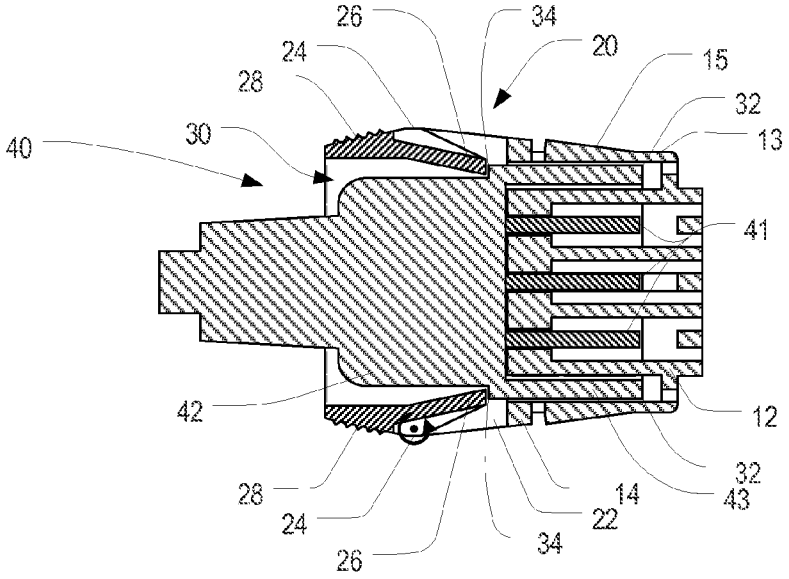
FIG. 6D is a top cross-sectional view of the electrical receptacle unit and plug of FIG. 6A, taken along line 6D-6D, showing the plug fully inserted into the receptacle.
Figure 6E:
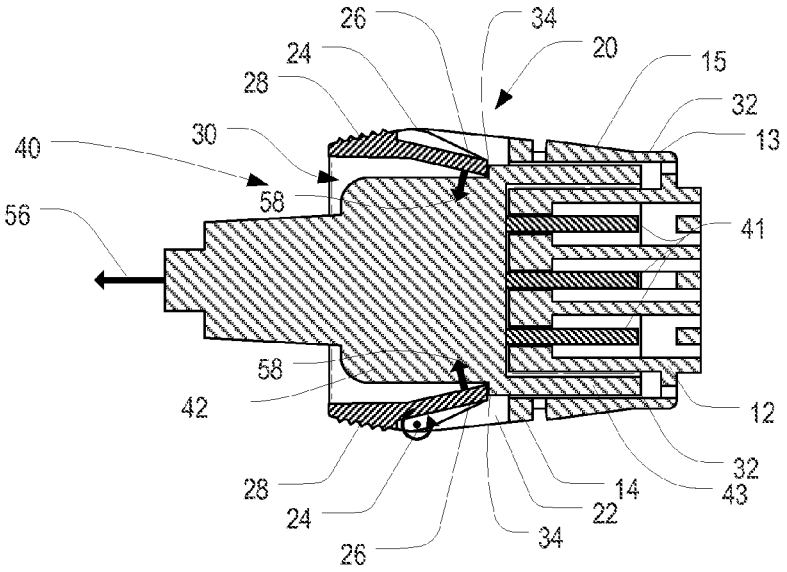
FIG. 6E is a top cross-sectional view of the electrical receptacle unit and plug of FIG. 6A, illustrating the forces applied on the lock tabs when the plug is pulled from the receptacle.

Once the plug 40 is fully seated in the receptacle unit 10, trailing edges 34 of the sides of the plug 40 have passed completely by the lock tabs 26, at which point the lock tabs 26 spring back to their original positions. This arrangement is shown in FIG. 6D, which is a top cross-sectional view of the electrical receptacle unit 10 and plug 40 of FIG. 4, taken along line 6D-6D. In their normal, unbiased state, the ends of the locking tabs 26 are disposed against or adjacent the trailing edges 34 of the plug 40, thereby blocking the plug 40 from being removed. Furthermore, because the force 56 applied on the locking tabs 26 when the plug 40 is pulled outward tends to cause the locking tabs 26 to rotate around the axis defined by the torsion bars 24, such a force 56 will tend to cause the locking tabs 26 to be deflected inward, thereby providing even greater resistance to the pulling force 56 being applied. In other words, the locking feature actually increases its holding strength when the power cord is pulled because the locking tabs 26 are forced inward in that circumstance. This is illustrated in FIG. 6E, which is a top cross-sectional view of the electrical receptacle unit 10 and plug 40 of FIG. 6A, illustrating the forces 58 applied on the lock tabs 26 when a pulling force 56 is applied to the plug 40.

Figure 6F:
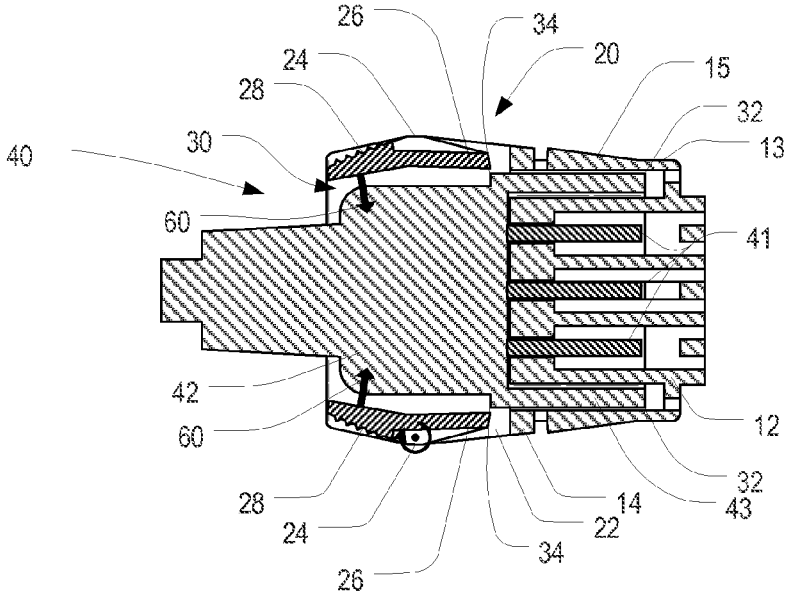
FIG. 6F is a top cross-sectional view of the electrical receptacle unit and plug of FIG. 6A, shown with the plug being released from the receptacle.

Although the lock tabs 26 prevent the plug 40 from being pulled from the receptacle unit 10 accidentally, the plug 40 nonetheless may be released easily from the lock housing 20 by manipulating the release tabs 28. In particular, the release tabs 28 may be gripped by hand and squeezed toward the sides of the plug 40, causing the lock tabs 26 to rotate around the torsion bar axis, away from the sides of the plug 12. This may be accomplished, for example, via a user's thumb and index fingers applying a force as represented by the arrows 60. In this regard, FIG. 6F is a top cross-sectional view of the electrical receptacle unit 10 and plug 40 of FIG. 6A, shown with the plug 40 being released from the receptacle unit 10. Once the lock tabs 26 have been rotated far enough that they no longer block the trailing edges 34 of the sides of the plug 40, the plug 40 may be easily removed from the female electrical fitting 12 and from the lock housing 20.

Figure 7:
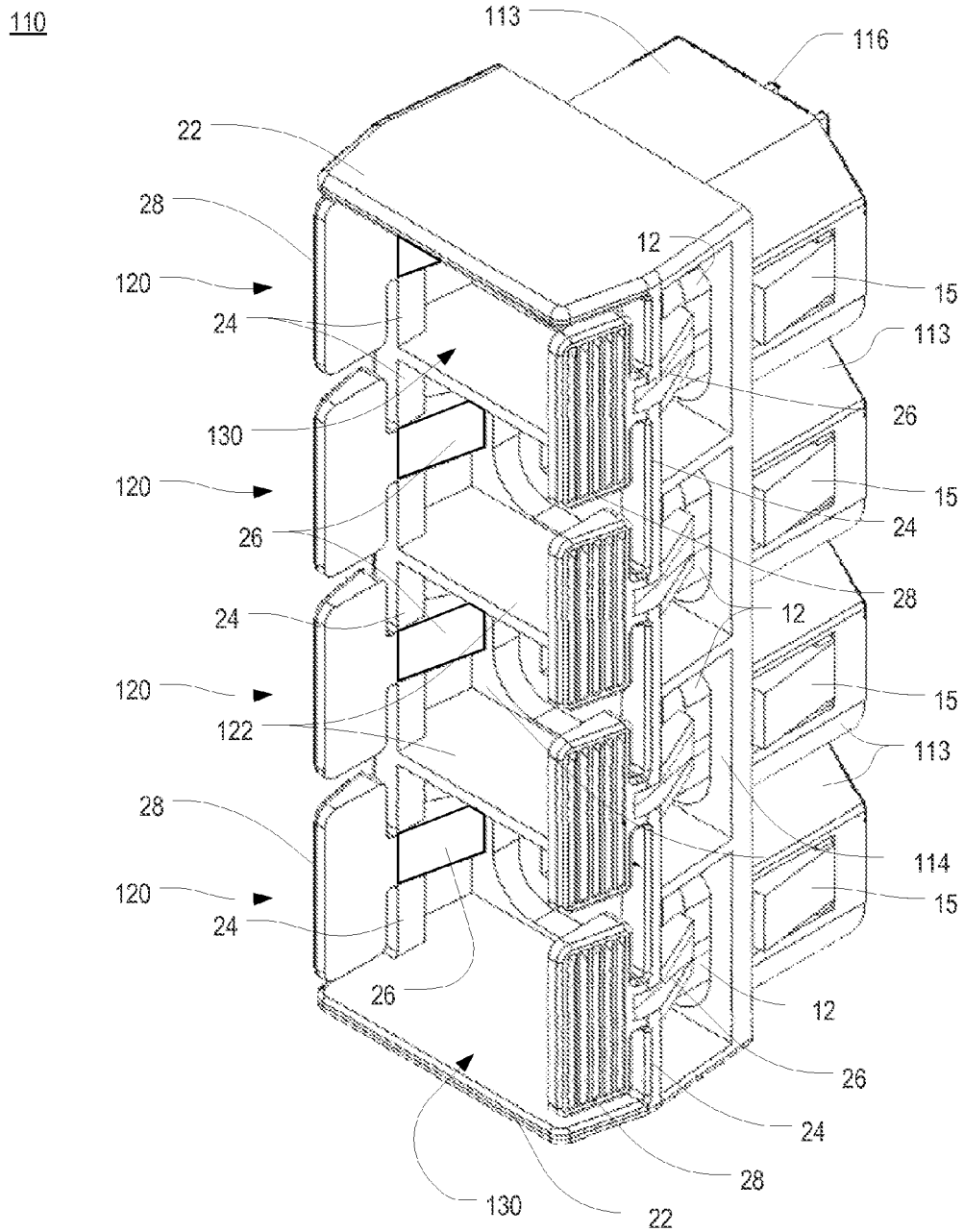
FIG. 7 is a front isometric view of a ganged electrical receptacle unit with locking feature in accordance with another preferred embodiment of the present invention.
Figure 8:
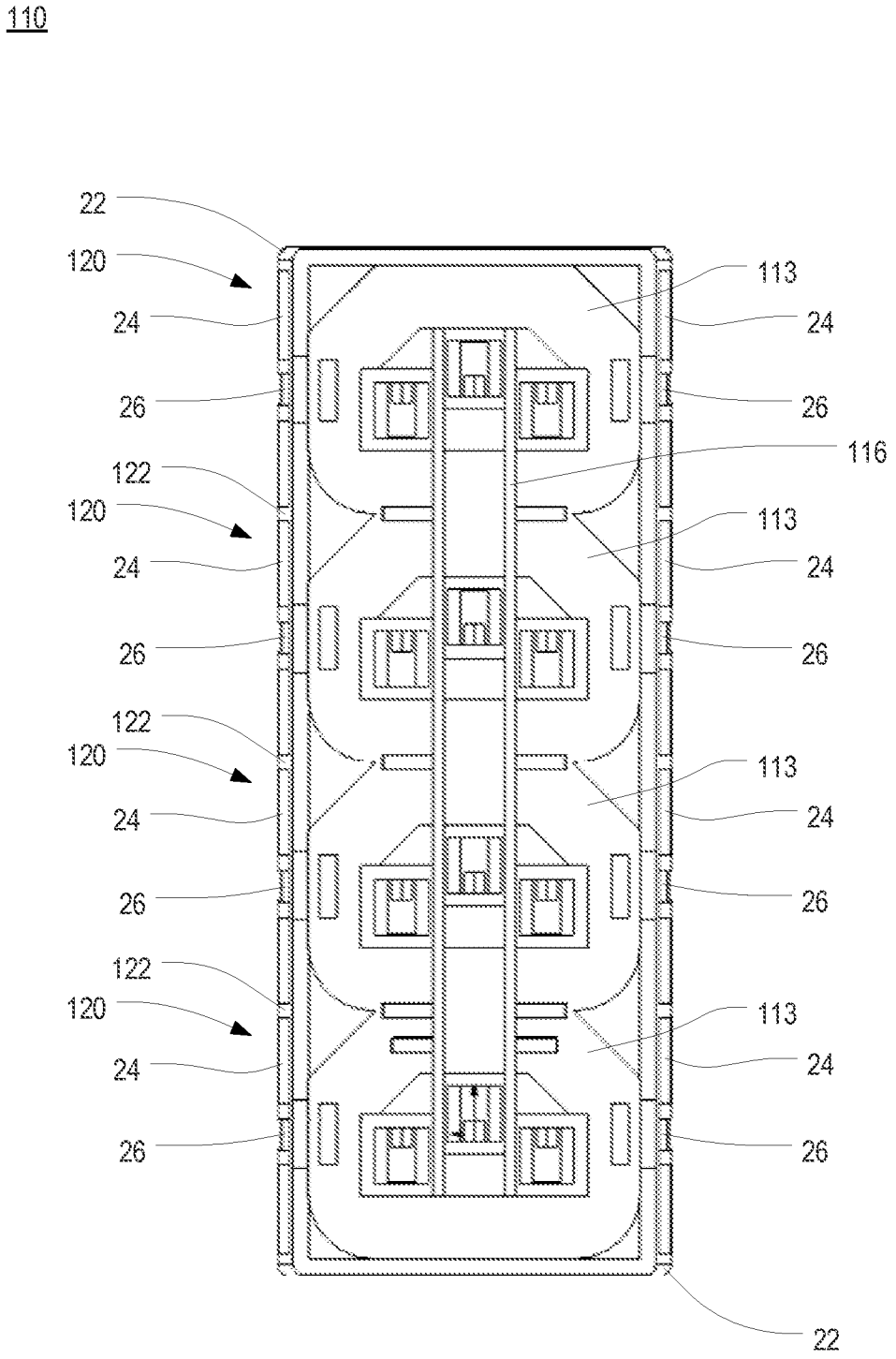
FIG. 8 is a rear view of the ganged electrical receptacle unit of FIG. 7.

FIGS. 7 and 8 are a front isometric view and a rear view, respectively, of a ganged electrical receptacle unit 110 with locking feature in accordance with another preferred embodiment of the present invention. As shown therein, the electrical receptacle unit 110 includes a ganged series of female electrical fittings 12, surrounding sockets 113, and lock housings 120 extending from the fronts of the sockets 113. In the illustrated embodiment, the female fittings, which have female electrical contacts contained therein, are similar to those of FIG. 2, but it will be again be appreciated that various other receptacle types with different electrical connection configurations also exist. A single continuous plate 114 is provided on the front of the sockets 113. In at least some embodiments, the plate 114 is integral with the socket 113, but in other embodiments the plate 114 may be attached during or after manufacturing. Further, in some alternative embodiments, the plate is omitted entirely. In other embodiments, the plate is integral with, or attached to, one or more of the electrical fittings.

The receptacle unit 110 may be mounted in various fixtures using screws, solder joints, or in other known ways; the receptacle (and especially the socket) may include additional features to facilitate such mounting. In accordance with one or more preferred approaches to mounting the receptacle unit 110, the walls of one or more of the sockets 113 may include locking tabs 15 that are naturally depressed as the sockets 113 are maneuvered into position in a fixture (not shown), but are biased to spring outward when the sockets 113 are fully inserted into such fixture, thereby holding the receptacle unit 110 in place in the fixture.

In at least some embodiments, the lock housings 120 are integral with the plate 114 and/or sockets 113 of the receptacle unit and is co-manufactured with the plate 114 and/or sockets 113, while in others the lock housings 120 are manufactured separately from the plate 114 and/or sockets 113 and are fastened thereto. Furthermore, in at least some embodiments, the lock housings 120 are integral with one another and are co-manufactured with one another, while in others the lock housings 120 are manufactured separately from one another and are fastened together. Still further, in at least some embodiments, the sockets 113 are integral with one another and are co-manufactured with one another, while in others the sockets 113 are manufactured separately from one another and are fastened together. In the illustrated embodiment, the sockets 113 are ganged together via an integral backbone 116.

An upper or lower side support 22 is disposed at each end of the ganged series of lock housings 120, and intermediate side supports 122 are interspersed between the sockets 113. In the illustrated embodiment, the upper and lower end side supports 22 and the intermediate side supports 122 all extend forwardly from the plate 114, but it will be appreciated that side supports or similar structures could alternatively or additionally extend from other portions of the socket 113 or other structure(s). Each pair of adjacent end (upper and lower) and intermediate side supports 22,122 are connected by a pair of torsion bars 24. Each torsion bar 24 supports a lock tab 26 and a release tab 28 extending in generally opposite directions therefrom. The side supports 22,122 and release tabs 28 of each lock housing 120 collectively frame a lock housing opening 130.

Figure 9:
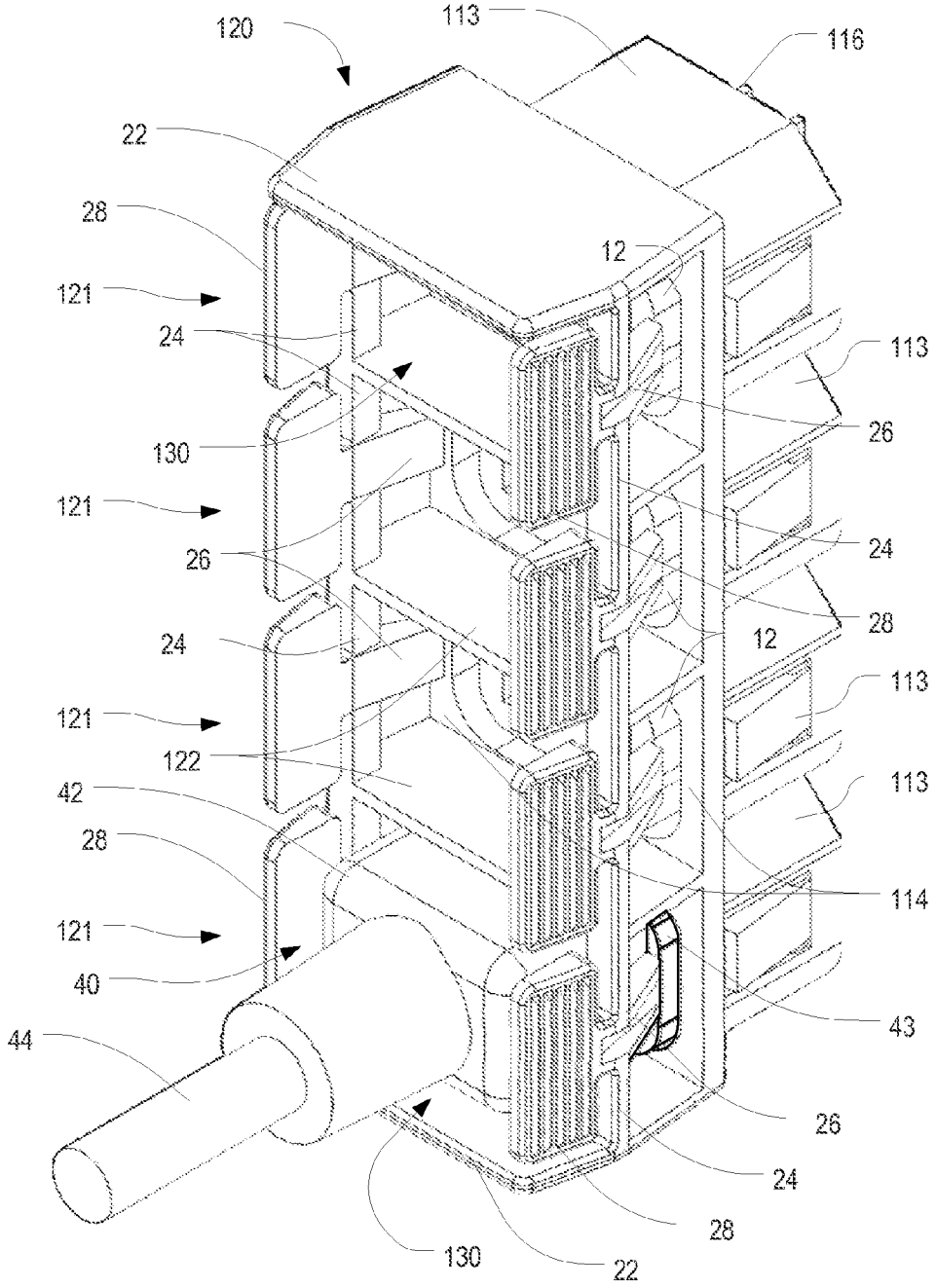
FIG. 9 is a front isometric view of the ganged electrical receptacle unit of FIG. 7, shown with a plug of a power cord connected thereto.

Each female electrical fitting 12 is adapted to receive a corresponding male electrical fitting. In this regard, FIG. 9 is a front isometric view of the ganged electrical receptacle unit of FIG. 7, shown with a plug 40 of a power cord connected thereto. As described previously, the power cord includes a plug 40 attached to the end of an electrical cable 44. The plug 40 includes a male fitting 42, from which male electrical contacts 41, extend as well as a socket 43 surrounding the male electrical contacts 41. As shown in FIG. 9, the plug 40 may be inserted through one of the lock housing openings 130 and into the receptacle unit 110 such that a conventional electrical connection is established and maintained. In at least some embodiments, the plug 40 is of conventional construction, as is the electrical cable 44 to which it is attached. When fully seated in the lock housing opening 130 and socket 113, as shown in FIG. 9, the plug 40 is retained by the lock housing 120 such that it will not become "unplugged" or otherwise disconnected accidentally. The operation of the lock housing 120 is similar to that of the lock housing 20 of FIGS. 6A-6F.

It will be appreciated that although the receptacle units 10,110 described and illustrated herein utilize female electrical fittings 12 and female electrical contacts that are adapted to receive male electrical fittings 42 and male electrical contacts 41, receptacle units (not shown) could additionally or alternatively be provided with male electrical fittings and/or male electrical contacts that are adapted to be received by power cords having plugs with female electrical fittings and/or female electrical contacts.

Based on the foregoing information, it will be readily understood by those persons skilled in the art that the present invention is susceptible of broad utility and application.

Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. An electrical receptacle unit with locking feature, comprising:

a receptacle adapted to be electrically connected to a source of electricity and having a front; and a lock housing extending from the front of the receptacle and adapted to surround a plug and temporarily lock the plug in place in coupling disposition with regard to the receptacle; the lock housing including:

a pair of opposed side supports, a pair of torsion bars, each torsion bar extending between and supported by the opposed side supports, and respective first and second free tabs extending from a midsection of each torsion bar in opposite directions from one another, wherein one of the first and second free tabs of each torsion bar is a lock tab.

2. The electrical receptacle unit of claim 1, wherein:

the receptacle includes an electrical fitting, having electrical contacts contained therein and/or extending therefrom;

the receptacle includes a socket surrounding the electrical fitting; and the lock housing extends from a plate disposed on the front of the socket.

3. The electrical receptacle unit of claim 2, wherein:

the electrical fitting is a first electrical fitting;

each lock tab extends from the respective torsion bar toward the electrical fitting; and a plug, including a second electrical fitting that mates to the first electrical fitting, may be inserted into the lock housing such that the plug causes the temporary deflection of the lock tabs until the plug is coupled to, and electrically connected with, the receptacle, at which point the lock tabs return to their undeflected positions and retain the plug coupled to the receptacle in its electrically connected state.

4. The electrical receptacle unit of claim 3, wherein:

for each torsion bar, the other of the first and second free tabs of each torsion bar is a release tab extending from the respective torsion bar away from the electrical fitting; and the release tabs may be depressed to release the lock tabs from the plug, thereby permitting the withdrawal of the plug from the lock housing.

5. The electrical receptacle unit of claim 3, wherein the opposed side supports are upper and lower side supports.

6. The electrical receptacle unit of claim 3, wherein the opposed side supports are left and right side supports.

7. The electrical receptacle unit of claim 2, wherein the receptacle is a panel-mount receptacle.

8. The electrical receptacle unit of claim 7, wherein the socket of the receptacle includes walls, at least one of which walls includes a locking tab that retains the receptacle in a fixture.

9. The electrical receptacle unit of claim 2, wherein the electrical fitting is a female electrical fitting having female electrical contacts contained therein.

10. The electrical receptacle unit of claim 2, wherein the plug and receptacle are of a C13/C14-type.

11. The electrical receptacle unit of claim 1, wherein the receptacle includes an electrical fitting, having electrical contacts contained therein and/or extending therefrom; and the lock housing extends from a plate disposed on the front of the electrical fitting.

12. A ganged electrical receptacle unit with locking feature, comprising:

a plurality of receptacles ganged together and each having a front, the ganged receptacles being adapted to be electrically connected to a source of electricity; and a lock housing extending from the front of at least one of the ganged receptacles and adapted to surround a plug and temporarily lock the plug in place in coupling disposition with regard to the at least one ganged receptacle, the lock housing including:

a pair of opposed side supports, a pair of torsion bars, each torsion bar extending between and supported by the opposed side supports, and respective first and second free tabs extending from a midsection of each torsion bar in opposite directions from one another, wherein one of the first and second free tabs of each torsion bar is a lock tab.

13. The ganged electrical receptacle unit of claim 12, wherein a respective lock housing extends from the front of each of the ganged receptacles.

14. The ganged electrical receptacle unit of claim 13, wherein, for each respective receptacle and lock housing:

the receptacle includes an electrical fitting, having electrical contacts contained therein and/or extending therefrom;

the receptacle includes a respective socket surrounding the electrical fitting; and the lock housing extends from a plate disposed on the front of the socket.

15. The ganged electrical receptacle unit of claim 14, wherein, for each respective receptacle and lock housing:

the electrical fitting is a respective first electrical fitting;

the lock housing includes:

a pair of opposed side supports, a pair of torsion bars, each torsion bar extending between and supported by the opposed side supports, and respective first and second free tabs extending from a midsection of each torsion bar in opposite directions from one another, wherein one of the first and second free tabs of each torsion bar is a lock tab that extends toward the electrical fitting and the other of the first and second free tabs of each torsion bar is a release tab that extends away from the electrical fitting;

a plug, including a second electrical fitting that mates to the first electrical fitting, may be inserted into the lock housing such that the plug causes the temporary deflection of the lock tabs until the plug is coupled to, and electrically connected with, the receptacle, at which point the lock tabs return to their undeflected positions and retain the plug coupled to the receptacle in its electrically connected state; and the release tabs may be depressed to release the lock tabs from the plug, thereby permitting the withdrawal of the plug from the lock housing.

16. The ganged electrical receptacle unit of claim 15, wherein each pair of adjacent receptacles shares a side support.

17. The ganged electrical receptacle unit of claim 15, wherein the lock housings are ganged together.

18. The ganged electrical receptacle unit of claim 17, wherein the lock housings are integral with one another.

19. The ganged electrical receptacle unit of claim 17, wherein the lock housings are produced separately but are attached to each other.

20. The ganged electrical receptacle unit of claim 15, wherein the lock housings are integral with the ganged receptacles.

21. The ganged electrical receptacle unit of claim 15, wherein the lock housings are produced separately from the ganged receptacles but are attached to the ganged receptacles.

22. The ganged electrical receptacle unit of claim 15, wherein each lock housing includes a front plate from which the side supports extend.

23. A ganged electrical receptacle unit with locking feature, comprising:

a plurality of receptacles ganged together, the ganged receptacles being adapted to be electrically connected to a source of electricity, wherein each receptacle includes a first electrical fitting and a respective socket, having a front, that surrounds the first electrical fitting; and a lock housing extending from the front of the socket of at least one of the ganged receptacles, wherein the lock housing includes:

a pair of opposed side supports, a pair of torsion bars, each torsion bar extending between and supported by the opposed side supports, a respective lock tab extending from each torsion bar toward the at least one ganged receptacle, and a respective release tab extending from each torsion bar away from the at least one ganged receptacle;

wherein a plug, including a second electrical fitting that mates to the first electrical fitting, may be inserted into the lock housing such that the plug causes the temporary deflection of the lock tabs until the plug is seated in, and electrically connected with, the at least one ganged receptacle, at which point the lock tabs return to their undeflected positions and retain the plug coupled to the at least one ganged receptacle in its electrically connected state; and wherein the release tabs may be depressed to release the lock tabs from the plug, thereby permitting the withdrawal of the plug from the lock housing.

24. The electrical receptacle unit of claim 1, wherein, locking and releasing of the plug is actuated by temporary rotation of the first and second free tabs of each torsion bar about an axis of rotation defined by the respective torsion bar.

* * * * *